US005571327A

United States Patent [19]

Ookouchi et al.

[11] Patent Number: 5,571,327

[45] **Date of Patent: * Nov. 5, 1996**

[54] CONTINUOUS HOT DIPPING APPARATUS AND SLIDE BEARING STRUCTURE THEREFOR

[75] Inventors: Takahiko Ookouchi; Tamihito Kawahigashi; Masatoshi Seki, all of Katsuta; Junji Sakai, Ibaraki-ken; Hitoshi Okoshi, Hitachi; Yoshitaka Nakayama, Hitachiota, all of Japan

[73] Assignee: Hitachi, Ltd., Tokyo, Japan

[ * ] Notice: The portion of the term of this patent subsequent to Oct. 12, 2010, has been disclaimed.

[21] Appl. No.: 16,928

[22] Filed: Feb. 12, 1993

[30] Foreign Application Priority Data

Feb. 12, 1992 [JP] Japan ..... 4-024994

[51] Int. Cl.[6] ..... B05C 3/00

[52] U.S. Cl. ..... 118/423; 492/58; 492/27; 492/28; 384/911

[58] Field of Search ..... 492/3, 15–17, 492/38–40, 27, 47, 54, 58, 28; 118/419, 423; 384/902, 907.1, 911, 420, 279, 297, 418, 419, 910, 434

[56] References Cited

U.S. PATENT DOCUMENTS 4,054,337 10/1977 Matt et al. ..... 384/911
5,072,689 12/1991 Nakagawa et al. .
5,073,415 12/1991 Taylor et al. ..... 118/423
5,252,130 10/1993 Ookouchi et al. .

FOREIGN PATENT DOCUMENTS 0346855 12/1989 European Pat. Off. .
0056619 3/1987 Japan ..... 384/907.1
0093620 4/1989 Japan ..... 384/907.1
0150019 6/1989 Japan ..... 384/907.1
3177552 8/1991 Japan .
4158910 6/1992 Japan ..... 492/3

OTHER PUBLICATIONS

Patent Abstracts of Japan, unexamined applications, C section, vol. 15, No. 425, Oct. 29, 1991, The Patent Office Japanese Government, Abstract, p. 162 C 879, JP–A–03 177 552 (Hitachi).

*Primary Examiner*—Brenda A. Lamb
*Attorney, Agent, or Firm*—Antonelli, Terry, Stout & Kraus

[57] ABSTRACT

A continuous hot dipping apparatus which comprises a slide bearing structure of a bearing and a roll shaft which is of a combination of a ceramic material and a solid lubricant material, and which has good wear resistance and long term durability. A heat resistant steel is provided, which is used in a molten metal of hot dipping and which essentially consists of 0.15–0.30% C, not more than 20% Si, not more than 2% Mn, 20–30% Cr, 10–20% Ni and not less than 50% Fe.

4 Claims, 8 Drawing Sheets

CONTINUOUS HOT DIPPING APPARATUS AND SLIDE BEARING STRUCTURE THEREFOR

FIELD OF THE INVENTION

The present invention relates to a continuous hot dipping apparatus and, more particularly, to a roll bearing device for a continuous hot dipping bath which bearing device has excellent properties against corrosion by molten metal, wear due to a load from a roll shaft, and to a sink roll, a support roll, a bearing, a slide bearing structure and a sliding member for use in this device.

BACKGROUND OF THE INVENTION

A roll bearing for a continuous hot dipping bath has generally been fashioned of a stainless steel, high-chromium steel, sintered carbide, etc. representing materials having excellent properties with respect to corrosion resistance, through build-up welding or a sleeve type construction. However, these materials wear and can be damaged, for example, after about one week of immersion in a hot zinc dipping bath. As a result of the damage, a play results between a roll shaft and the roll bearing, and a roll and a hot dipping apparatus will oscillate, thereby adversely affecting the plating property. It has been found that it is difficult to completely prevent corrosion of a metal due to molten metal even if the metal, relatively excellent with respect to corrosion resistance, such as, for example, stainless steel, high-chromium steel and sintered carbide is employed. Consequently, corrosion wear due to molten metal as well as friction is caused at the time of sliding of the roll bearing, thus increasing the wearing depth. It has also been determined that when corrosion reaches a certain stage, corrosion pits are formed in the sliding surfaces of the roll shaft and bearing thereby promoting additional wear due to friction.

In order to decrease the wearing of the roll bearing, it is necessary to select a material which is excellent in corrosion resistance against molten metal. In this connection, some ceramics exhibit little corrosion due to molten metal, and such ceramics can be regarded as the optimum material for a roll bearing for a hot dipping bath.

In, for example, JP-A-3-177552, a bearing for a continuously operating hot dipping bath is proposed wherein a sintered ceramic member is closely fitted on the outer peripheral surface of a roll shaft through a metallic buffer material, and a solid lubricant ceramic material is provided on an inner peripheral surface of the bearing.

In the above-described conventional technique, problems of a combination of the ceramic and the solid lubricant during actual operation in the continuous hot dipping bath are not considered.

In other words, it has been determined that although ceramics are excellent in corrosion resistance against molten metal, a new problem arises, namely that of inter metallic compounds generated as a result of a reaction between various metallic construction members in a hot dipping bath tank and the molten metal adversely affecting the solid lubricant.

SUMMARY OF THE INVENTION

An object of the present invention is to provide a continuous hot dipping apparatus in which a combination of a ceramic and a solid lubricant member is employed as a slide bearing structure of a bearing and a shaft so as to enhance corrosion resistance and wear resistance, thereby increasing the durability of the slide bearing, and to provide a sink roll, a support roll, a bearing, a slide bearing structure and a sliding member for use in the dipping apparatus.

According to the present invention, a continuous hot dipping apparatus is provided which includes at least one roll, comprising a pair of roll shafts at the both end portions thereof, which is supported at the roll shafts by a pair of bearings and rotates in a molten metal bath. In the dipping apparatus, one of the contact portion of the each roll shaft and the contact portion of the each bearing is formed of a sintered ceramic member, and the other is formed of a solid lubricant member, the entire periphery of the roll shaft contact portion being formed of the sintered ceramic or solid lubricant member, and the bearing contact portion being formed of the integral solid lubricant or sintered ceramic member having at least an arcuate shape or having a semicircular or circular shape.

According to the present invention, a continuous hot dipping apparatus includes a sink roll and support rolls, each of which comprises a pair of roll shafts at the both ends thereof and is supported by a pair of bearings, the rolls rotating in a molten metal bath, and the entire periphery of the contact portion of the each roll shaft of at least one of the sink roll and the support rolls being formed of a sintered ceramic member, and the contact surface of the bearing being formed of an integral solid lubricant member having at least an arcuate shape, or preferably a semicircular or circular shape.

In accordance with a further feature of the hot dipping apparatus of the present invention, the roll is made of a heat resistant alloy. A plurality of cylindrical sintered ceramic members are fitted and secured on the entire peripheral surfaces of the roll shafts. The roll shafts and a roll body are part of an integral structure. Each of intermediate zones between the roll body and the roll shafts becomes gradually large in diameter from the roll shaft toward the roll body. A metallic ring is provided on the respective intermediate zones of the roll.

In accordance with another feature of the above-described dipping apparatus of the present invention at least one of the sink roll and the support rolls is made of an Fe-, Ni- or Co-base alloy system whose Cr content is 20 wt % or more, and a plurality of rings formed of a sintered ceramic member are respectively fitted and secured on the entire peripheral surface of the roll shaft.

In accordance with another feature of the above-described apparatus of the present invention, the contact portion of the bearing has a semicircular or circular shape. The entire periphery of the semicircular or circular portion is formed of a sintered ceramic member or a solid lubricant member. The sintered ceramic member or the solid lubricant member is fitted and secured on a metallic base of the bearing, and the contact surface is projected from the inner surface of the metallic base and brought into contact with the contact surface of a roll shaft so that the roll shaft contact surface and the bearing contact surface slidingly contact each other in planar contact.

According to another feature of the hot dipping apparatus of the present invention, a sink roll or a support roll is made of a heat resistant steel consisting essentially of, by weight, 0.15 to 0.30% C, not more than 2% Si, not more than 2% Mn, 20 to 30% Cr, 10 to 20% Ni, and not less than 60% Fe, and comprises a cylindrical sintered ceramic member which is divided into a plurality of sections in the axial direction and which is fitted and secured on the entire peripheral surface of the roll shaft with respect to a bearing.

According to another feature of the present invention, a bearing is provided. The inner surface of a metallic base of the bearing is of a semicircular or circular shape. A sintered ceramic member or a solid lubricant member is fitted and secured on the entire periphery of the inner surface. The contact surface, which is brought into contact with a roll shaft, is projected from the inner surface of the metallic base.

According to another feature of the present invention, a bearing for a continuous hot dipping apparatus is provided. A base (or body) of the bearing is made of a heat resistant steel consisting essentially of, by weight, 0.15 to 0.30% C, not more than 2% Si, not more than 2% Mn, 20 to 30% Cr, 10 to 20% Ni, and not less than 50% Fe, and has a semicircular or circular shape. A sintered ceramic member or a solid lubricant member is fitted and secured on the inner surface of the metallic base. The contact surface, which is brought into contact with a roll shaft, is projected from the inner surface of the metallic base.

According to a further feature of the above-described dipping apparatus, the metallic base of the bearing, a supporting member for the bearing and the roll are made of a heat resistant steel consisting essentially of, by weight, 0.15 to 0.30% C, not more than 2% Si, not more than 2% Mn, 20 to 30% Cr, 10 to 20% Ni, and not less than 50% Fe.

According to a still further feature of the above-described hot dipping apparatus, a graphite composite member comprising carbon fibers having a bending strength of 10 $kg/mm^2$ or more is fitted and secured on the inner surface of the metallic base of the bearing or the contact portion of the roll shaft.

According to another feature of the present invention, a slide bearing structure is provided, in which a sintered ceramic member or a metal member and a solid lubricant member slide in contact with each other. The solid lubricant member is formed of a graphite composite member comprising carbon fibers which are directed in such a direction that the longitudinal direction intersects with the slide-contacting.

According to another feature of the present invention, a slide bearing structure is provided, which comprises a roll. The roll has an integral structure comprising a body and a shaft, and is supported by a bearing. An intermediate zone between the body and the shaft becomes gradually large in diameter from the shaft to the body. A cylindrical sintered ceramic or solid lubricant member is closely fitted on the entire peripheral surface of the roll shaft. The sintered or solid lubricant member is closely fitted on the shaft. A metallic ring is provided between the sintered or solid lubricant member and the body.

According to another feature of the present invention, a sliding member is provided, in which fibers are dispersed and oriented in a single direction in a solid lubricant material, the fibers having a higher hardness or strength than the solid lubricant material. The longitudinal direction of the fibers is oriented to intersect with the slide-contact surface of the sliding member.

According to a further feature of the present invention, a sliding member is provided, in which carbon fibers are dispersed and oriented in one direction in graphite. The longitudinal direction of the carbon fibers is oriented to intersect with the slide-contact surface of the sliding member.

According to one aspect of the present invention, a heat resistant steel for a hot dipping apparatus is provided. The steel consists essentially of, by weight, 0.15 to 0.30% C, not more than 2% Si, not more than 2% Mn, 20 to 30% Cr, 10 to 20% Ni, and not less than 50% Fe, and contains eutectic carbide and is entirely an austenitic structure.

The slide-contact portion of the roll shaft is a composite structure consisting of a ceramic member and a metallic base member of the roll shaft which are fitted with each other, as described above. An intermediate material which is elasto-plastically deformable by a force lower than the rupture strength of the ceramic member is interposed between the members, so that elasto-plastic deformation of the intermediate material is caused at least at a temperature at which it is used, and so that elasto-plastic deformation of the intermediate material is caused due to a thermal expansion difference between the two members, the intermediate material being located with a residual space into which the material can move when deformed. The ceramic member is securely fixed on the metallic base member via the intermediate material.

Furthermore, the slide-contact portion of the roll shaft of at least one of the sink roll and the support rolls is a composite structure consisting of a ceramic member and a metallic base member which are fitted with each other, with an intermediate material provided between the two fitted members in substantially the same manner as described above. The intermediate material is located with a residual space in which the intermediate material can be elasto-plastically deformed due to a thermal expansion difference between the both members at least at a temperature at which it is used.

According to another aspect of the present invention, a hot dipping system is provided, which comprises the steps of moving a steel strip at high speed, annealing it continuously, guiding the steel strip by a roll, immersing it in a molten metal bath, coating it with the molten metal to form a coating layer thereon, moving the steel strip vertically upwards, injecting high-speed gas toward the coating layer on the steel strip moving vertically upwards so as to control a thickness of the coating over the strip to have a uniform thickness, and continuously producing a plated steel sheet by using steel strips of the same kind and using the same plating composition, wherein the slide-contact surface of a roll shaft and the slide-contact surface of a bearing are formed of a combination of a solid lubricant member and a sintered ceramic member, and the both members are in planar-contact with each other. Thus, wear is substantially prevented, and oscillation of the steel strip which is moving at high speed immediately after plating is substantially eliminated. Tension applied in a moving direction of the steel strip is maintained at a substantially constant value, and the gas injection is maintained in a substantially constant condition.

In accordance with a further feature of the hot dipping system of the present invention, the slide-contact surface of the roll shaft and the slide contact surface of a bearing are formed of the above-mentioned combination of materials, so that oscillation of the steel strip which is moving at high speed immediately after plating can be substantially eliminated, tension applied in a moving direction of the steel strip can be maintained at a substantially constant value for at least two days continuously, and the coating layer of a substantially uniform thickness can be continuously plated on the steel sheet comprising steel strips of the same kind and the coating layer of the same plating composition at least in the above-mentioned term of continuous operation. The gas injection is maintained in a substantially constant condition for at feast two days so as to form the coating layer whose thickness vary from 10 to 50 μm, and to continuously produce the plated steel sheet comprising steel strips of the same kind and the coating layer of the same plating composition.

According to another feature of the present invention, a hot dipping system for continuously producing a plated steel sheet comprising steel strips of the same kind and a coating layer of the same plating composition is provided. In the dipping system, a roll shaft and a bearing are designed in substantially the same manner as described before so that wear of them is substantially prevented, and oscillation of the steel strip which is running at high speed immediately after plating is detected for automatic control such that tension applied in a moving direction of the steel strip and a condition of the gas injection will be maintained to be substantially constant.

The longer the term of continuous production, the higher the productivity is. However, as the continuous production term is longer, the quality of products is gradually deteriorated. Consequently, in this invention, it is possible to perform continuous production for about 30 days.

In the present invention, hot dipping is carried out for at least two days continuously. During the continuous operation, it is possible to obtain a steel strip whose plating thickness is not more than 50 μm and substantially uniform so that variation from a desired thickness is 5 μm or less. Various plating layer thicknesses of 2 to 10 μm, 10 to 20 μm, 20 to 30 μm, 30 to 40 μm, and 40 to 50 μm may be obtained by the hot dipping.

A ceramic material excellent in corrosion resistance against a molten metal is used for a slide-contact portion of a roll shaft and a bearing so that increased wearing due to corrosion may be prevented. Also, when one of them is formed of a high-strength, high-hardness ceramic material and the other is formed of a material having a solid lubrication property, the wearing coefficient can be made as small as 0.1 or less, and the galling resistance critical facial pressure can be made as large as 50 kgf/cm$^2$ or more. This is because of the effect of solid lubrication. With the effect, cracking of the ceramic due to sticking, galling and so on can be prevented. Moreover, with the above-mentioned combination, slight wear of the solid lubricant member at an initial stage of use serves to eliminate partial contact due to unevenness and eccentricity caused at the time of machining. Thus, the slide-contact surfaces of the roll shaft and the bearing are contacted with each other uniformly so that local friction can be prevented, and so that well-lubricated contact may be effected. Furthermore, the high-strength high-hardness ceramic material seldom wears, and it can maintain the smoothness of the slide-contact surface almost permanently. Therefore, the friction wearing of the solid lubricant material may be made 1/10 or less as compared with the conventional metal to metal contact.

In the present invention with the combination of the mating materials which are brought into contact with each other, the contact surface of the bearing has a semicircular or circular shape, and its entire periphery is formed of the ceramic or the solid lubricant member. The solid lubricant member can be prevented from being damaged by hard intermetallic compounds generated due to a reaction between the metallic base of the bearing and the molten metal. In order to make adverse affections due to the inter-metallic compounds as small as possible, the contact surfaces of the roll shaft and the bearing are designed to slide in planar contact, thereby preventing the compounds from entering the slide-contact zone and lengthening the durability.

Sialon is the most favorable as the high-strength sintered ceramic material. However, other materials such as SiC and $Si_3N_4$ which are sintered in vacuum, and $Al_2O_3$ and $ZrO_2$ which are normally sintered are also used. Since aluminum and zinc are used as a molten metal in the hot dipping, materials having corrosion resistance against those molten metals should preferably be employed. Further, as the high-strength high-hardness ceramic material, the above-mentioned one is particularly favorable. However, a material having a tensile strength of 200 MPa or more and a Vickers hardness of 10 GPa or more is preferable, and a carbide, a nitride, an oxide, a bride, a nitric oxide and a sintered composite ceramic material containing at least one thereof as a primary component are used. Especially, Sialon ceramic having the highest strength is favorable.

More specifically, in the case where a cylindrical ceramic member is closely fitted on a metallic roll shaft a metallic material of a low yield point which is elasto-plastically deformable by a force less than the rupture strength of the ceramic material is required to be interposed between the metallic roll shaft and the cylindrical ceramic member. Further, when the sintered ceramic member has a large size, it is divided into a plurality of sections in the axial direction. When this is the case, the reliability is improved with respect to various kinds of stress.

Concerning the bearing, also, when the ceramic or the solid lubricant member attached on it has a large size, the solid lubricant member having a semicircular or circular shape is divided to a plurality of sections in the axial direction and the sections are secured on the inner periphery of the metallic base of the bearing. As a securing method, it is effective, for example, to insert the plurality of sections into a dovetail groove formed in the inner peripheral surface of the metallic base and to securely fix them in the dovetail groove by means of bolts. Preferably, the plurality of sections are retained by the bolts through thin metallic plates.

The material having solid lubrication property is preferably a non-metal. The solid lubricant material may be a ceramic containing 1 to 70 volume % of a material excellent in solid lubrication property, such as graphite powder, carbon fibers, $MoS_2$, $WS_2$, BN or the like, which is dispersed in the sintered ceramic, or especially a sintered silicon carbide containing 1 to 70 weight parts (preferably, 15 to 40 weight %) of graphite powder having an average grain size of 50 μm or less or carbon fibers having a diameter of 150 μm or less which is dispersed in the sintered ceramics, a similar sintered material with a combination of silicon nitride and BN, or a material of boron nitride (BN) or graphite alone.

A graphite-carbon fibers composite material in which carbon fibers are dispersed in graphite is most excellent because it has a high strength. Especially, the material which has a three-point bending strength of 10 kg/mm$_2$ or more in an orientation direction of carbon fibers, or preferably the material which has a strength as high as 20 to 60 kg/mm$^2$ is used. When the carbon fibers are orientated in substantially one direction such that the longitudinal direction of the fibers intersects with the slide-contact surface or is parallel with a load direction, more excellent sliding performance can be obtained, and this arrangement is favorable because it can sustain a high load. Depending on a purpose, carbon fibers can be directed in such a manner that the longitudinal direction of the fibers extends along the slide-contact surface or is perpendicular to the load direction. As the carbon fibers, long fibers having a diameter of 10 μm or less (preferably, 0.1 μm to 10 μm) are used, and either a one-direction arrangement or mesh arrangement can be employed. The content of a the carbon fibers is 10 to 80 volume %, or preferably, 20 to 60 volume %. Graphite serves as a solid lubricant.

It is preferable to provide the solid lubricant member all over the semicircular or circular slide-contact surface. However, providing it all over the semicircular surface is rather tough from a structural point of view, and consequently, a semicircular solid lubricant member divided in the axial direction is provided.

In this invention, when a ceramic sleeve is attached on the outer periphery of the metallic roll shaft, the buffer material which is elasto-plastically deformable by a force less than the rupture strength of the ceramic sleeve is interposed between the ceramic sleeve and the metallic roll shaft before they are closely fitted with each other. Therefore, even if the common machining difference of the metallic roll shaft and the ceramic sleeve is large, strain generated due to a thermal expansion difference of the both members in the molten metal bath is absorbed by elasto-plastic deformation of the buffer material, so that the ceramic can be securely fixed on the metallic roll shaft without any damages of the ceramic sleeve such as cracking, breakage and the like. Also, since residual stress of the ceramic sleeve caused by fitting it on the roll shaft does not exceed the yield stress of the buffer material during the operation, the margin with respect to the load during the operation is high. It should be noted that similar effects may be expected from the above-described structure with relation to an impact load, and that it is suitable to use the buffer material in attaching the ceramic sleeve on the roll shaft.

Preferably, the intermediate buffer material for absorbing stress is a metal having a low yield point which is elasto-plastically deformable by a force less than the rupture strength of the ceramic sleeve and having an elasto-plastic deformation amount of 20% or less. Especially, Ti, Au, Ag, Al, Pd, Cu, Ni or an alloy containing at least one of them as a primary alloying element is used. Austenitic stainless steel or ferritic stainless steel having a Vickers hardness of 200 or less are perferable also preferably employed as the buffer material. Such a buffer material is provided in the entirety of the gap between the roll shaft and the ceramic sleeve. Alternatively, the buffer material cut back cut into elongated pieces which are partially inserted into the gap; and a residual space, into which the buffer material may be deformed, will be defined in the gap. Further, the residual space is preferably maintained even at a temperature of a molten metal for hot dipping.

The buffer material may be provided with an uneven surface having grooves, holes or other recesses to facilitate the elasto-plastic deformation. A thin wire or a thin pipe may be wound, as the buffer material, on the surface of the roll shaft. A corrugated plate material or a honeycomb flat plate material may be also used as the buffer material. A grooved sleeve having a large number of longitudinal grooves or lateral grooves in the outer peripheral surface or the inner peripheral surface or both surfaces of the sleeve may be also employed as the buffer material. Especially by using a thin pipe having an outer diameter of 5 mm or less which is made of the above-mentioned stainless steel, elasto-plastic deformation may be facilitated, and deformation of a large amount may be effected. Besides, since it still has elasticity after the deformation, it can be securely attached in a favorable condition. In this case, a material of the thin pipe whose strength is larger than that of a solid material can be used. Furthermore, projections having a shape easy to be deformed elasto-plastically can be provided on the surface of the cylindrical sleeve of the buffer material, which oppose to the ceramic sleeve. The projections may have any of an annular shape, a spiral shape, and a bar-like shape.

The buffer material may be obtained by metalizing on the surface of the roll shaft, and the metalization can be performed by a method such as thermal spraying, welding, and plating. Preferably, the surface of this layer should be formed to be uneven.

The cylindrical sintered ceramic sleeve may be mounted on the roll shaft by a shrinkage fitting method so that the roll shaft and the ceramic sleeve are closely fitted with each other, or a ceramic coating may be also provided on all over the outer periphery of the roll shaft by a thermal spraying method or a chemical vapor deposition method (CVD).

Preferably, the cylindrical ceramic sleeve attached on the roll shaft according to the present invention is retained fixedly by the metallic pressing plates (or retainer plates) and the springs from the end surface of the roll shaft, the springs are coil springs made of a heat resistant alloy, especially Cr steel, Ni—Cr steel, Cr—Ni—Co alloy system or such material containing proper amounts of W, Mo, Ti, Si, Nb and so forth is used as the heat resistant alloy, the ceramic sleeve is secured in the axial direction through a thermal expansion absorbing material, and the thermal expansion absorbing material has a thermal expansion coefficient larger than that of the roll shaft.

In the hot dipping apparatus of this invention, the sink roll, the support rolls, their bearings, the frame for sustaining the bearings and so forth are metallic members which are in contact with molten metal, and the above-mentioned heat resistant steel containing 20% or more Cr, or Ni alloy, or Co-base alloy is used for these members. Particularly, the heat resistant steel is preferred. In the steel, each alloying element is contained in the following reasons.

Carbon is used to obtain a required strength, and the content is not less than 0.15% and not more than 0.3%. If it is less than 0.15%, a sufficient strength can not be obtained, and if it exceeds 0.3%, a large effect can not be obtained.

Si and Mn are indispensable for deoxidation and desulfuration, and the content of each of them must be 2% or less to produce castings. Preferably, the content of each of them is 0.1 to 1%.

Not less than 20% content of Cr is required for reducing reaction with molten metal and decreasing formation of hard intermetallic compounds. However, if it exceeds 30%, a brittleness problem will arise. Therefore, the content is set at 30% or less. It is preferably 22 to 26%.

Not less than 10% content of Ni is required for enhancing the machinability at high temperature and increasing the toughness. However, if it exceeds 20%, a larger effect can not be obtained. Therefore, the content is set at 20% or less. It is preferably 12 to 18%.

Also, one or more of Ti, Nb, W, V, Zr and Al can be added to enhance the strength, the content of each being 1% or less.

Although either forging quality steel or cast steel can be used as metallic bases of the roll and the bearing, cast steel is preferred for the former. Also, either forging quality steel or cast steel can be used for pedestals for sustaining them, but cast steel is preferred from a manufacturing point of view. The above-described steel contains eutectic carbide, is of an entire austenitic structure, and has a more excellent high-temperature strength.

Moreover, ferritic steel consisting essentially of not more than 0.15% C, not more than 1% Si, not more than 1% Mn, 10 to 15% Cr, not more than 6% Ni, and the balance of Fe, or low alloy steel containing 0.1 to 0.35% C, not more than 1% Si, not more than 1.5% Mn, 0.5 to 3% Cr, and not more than 2% Ni can be used.

In the present invention, the ceramic which is excellent in respect of corrosion resistance, wear resistance and sliding properties can be highly reliably provided on the sliding portion of the roll bearing, so that the roll bearing exhibits long-term durability in the hot dipping bath, and so that it is possible to conduct the operation ten times longer than the case with a roll bearing made of the conventional metal. Thus, this invention produces effects such as decreasing replacement frequency of the roll bearing, improving the productivity by continuous operation, reducing defective products, and so forth.

EMBODIMENT 1

Figure 1:
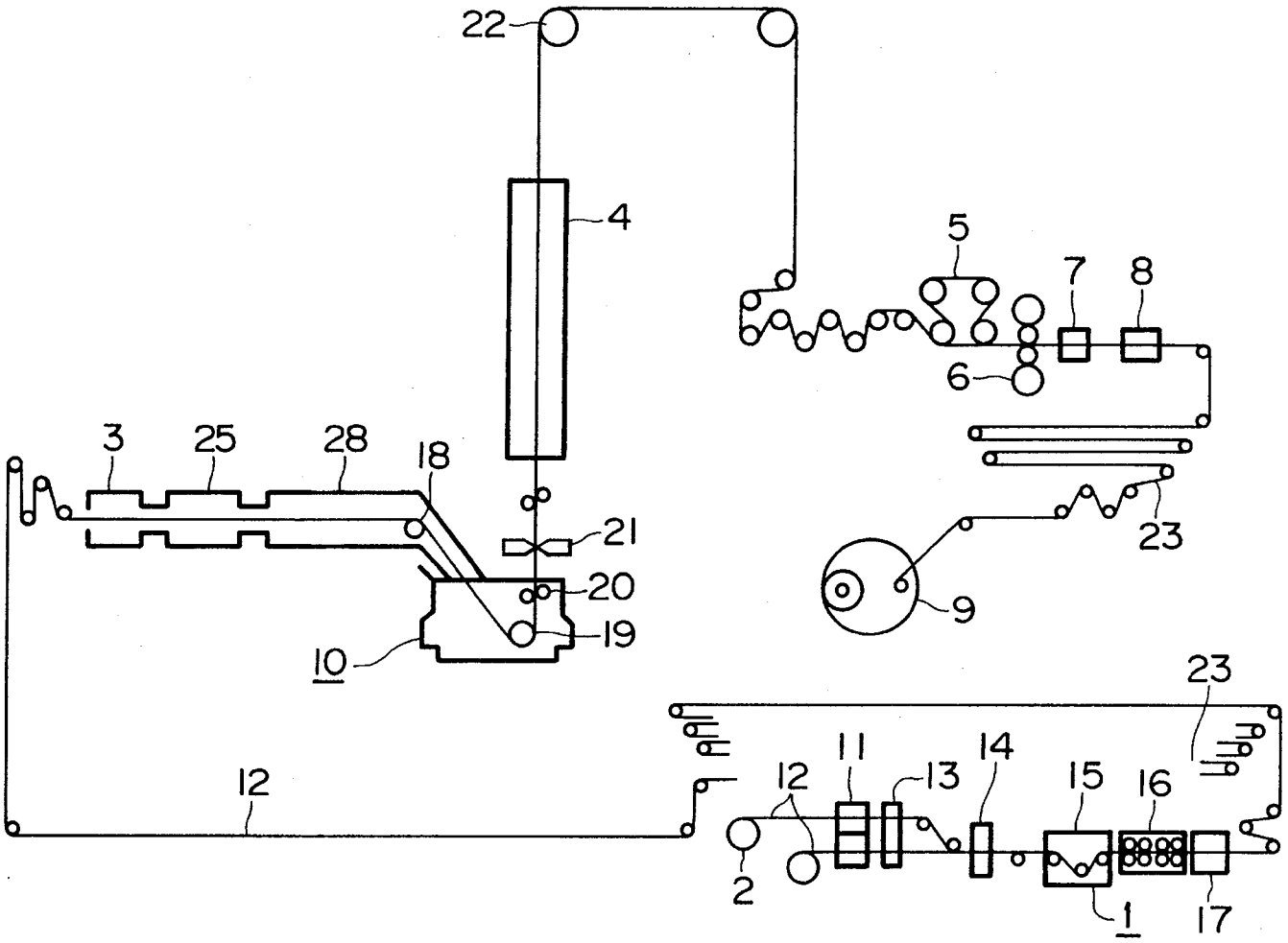
FIG. 1 is a diagram showing the structure of a continuous molten zinc hot dipping apparatus according to the present invention.

FIG. 1 is a schematic view showing all the treatment processes according to a particular embodiment of a continuous hot dipping apparatus for zinc of the present invention. A steel strip 12 which is a material to be plated is rolled on a pay-off reel 2. It is fed through a leveler 11, a shearing machine 13 and a welder 14. Further, the steel strip 12 is delivered through an electrolytic cleaning tank 15, a scraper 16 and a rinsing tank 17 to a non-oxidation annealing furnace 3. After the steel strip 12 is annealed, it is passed through a reducing furnace 25 and a cooling zone 28, and plated in the hot dipping apparatus 10. The strip 12 which has been immersion-plated while passing the apparatus 10 is moved vertically upwards at high speed and passed through a surface controller 4. Then, it is delivered through a bridle roll device 5, a skin pass mill 6, a tension leveler 7, a chemical conversion treatment device 8 and so forth, and wound on a tension reel 9 by way of a looper 23. Tension applied to the strip 12 is controlled by the roll device 5 and a tension bridle (not shown).

Figure 2:
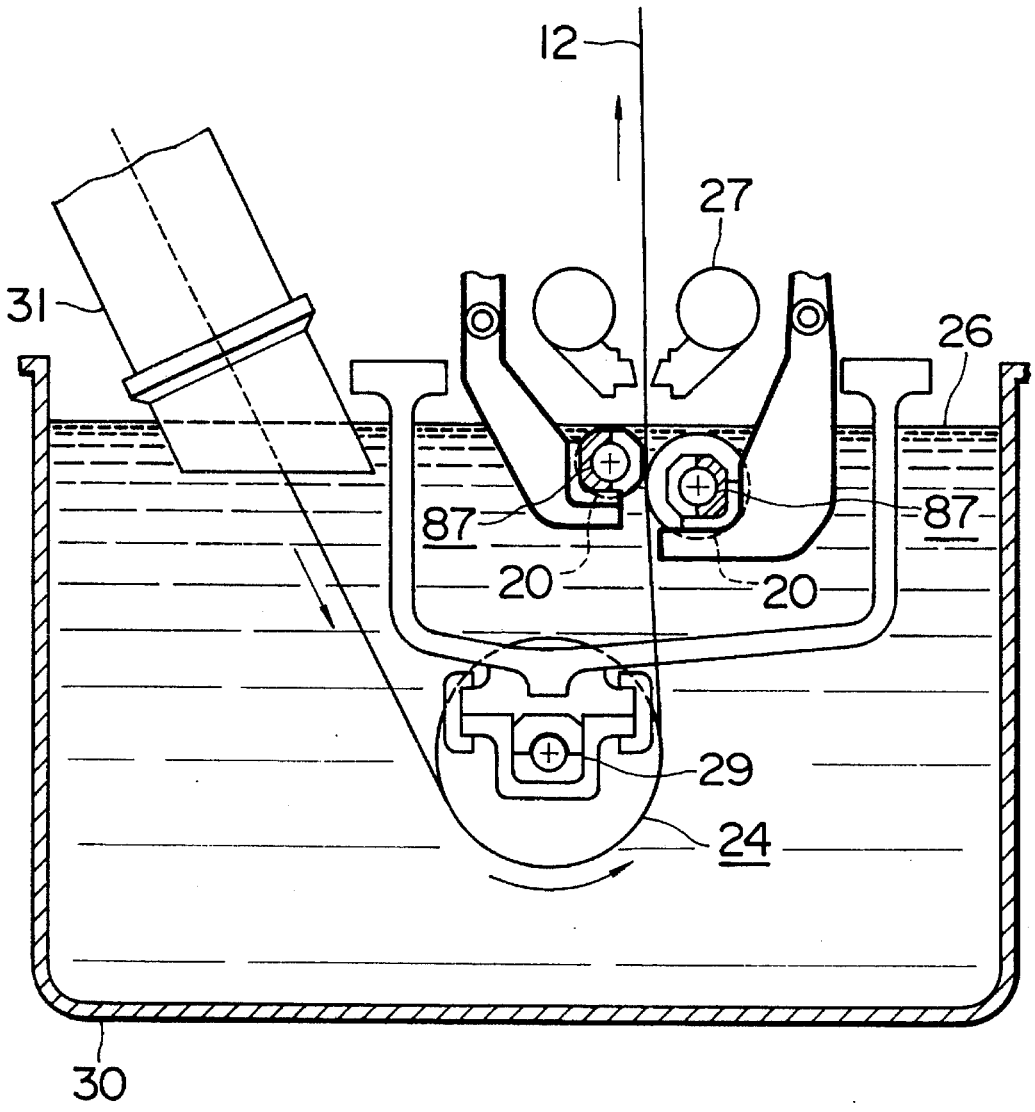
FIG. 2 is a cross-sectional view of a hot dipping tank for zinc.

This tension is controlled to have a constant degree in accordance with an amplitude of oscillation measured by an oscillation detector which is installed in the delivery line of the strip 12 immediately after wiping nozzles 21. An oscillation detector is provided at each treatment stage of the tension bridle. FIG. 2 is an enlarged view of the hot dipping apparatus 10.

The advancing direction of the strip 12 supplied through a snout 31 is changed in a hot dipping tank 30 by means of a sink roll device 24, and the movement of the strip 12 is stabilized by a support roll device 20 as depicted in FIG. 2. The strip 12 is moved at a speed as high as 50 to 100 m/minute.

Further, high-speed gas is injected toward the strip 12 drawn from a hot dipping molten metal 26 by means of the wiping nozzles 27 installed on both sides of the strip 12. The plating amount is controlled by controlling a gas pressure and an injection angle of this gas injection.

The guide roll device 20, a roll 19 of the sink roll device 24 and a roll bearing shell 29 which are used in the molten metal are lubricated by the molten metal, and consequently, the roll bearing shell 29 is a slide bearing structure.

As shown in FIG. 2, it is understood from observation of wear conditions of a conventional sink roll bearing that wear of the roll bearing occurs in a direction indicated by the arrow, i.e., in a direction of a vector of force generated when the strip 12 is bent by the sink roll device 24.

Figure 3:
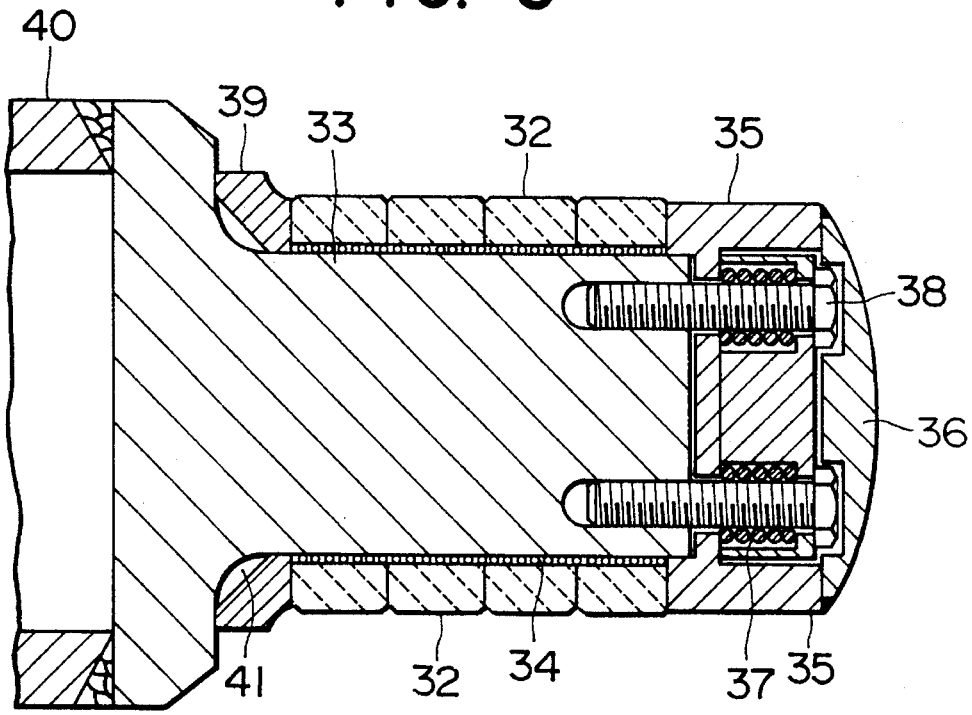
FIG. 3 is a cross-sectional view of a sink roll.

FIG. 3 is a cross-sectional view of the sink roll 19 according to the present invention. Sialon ceramic which exhibits an excellent corrosion resistance against molten metal and has a high-strength high-hardness property is selected for a cylindrical ceramic sleeve 32 divided into four and attached on a roll shaft 33. Sialon ceramic is expressed by $Si_{6-z}Al_zO_zN_{8-z}$, where Z is variable within the range of zero to 4.2, and is generally referred to as β-sialon. In this embodiment, Sialon powder having a composition with Z=0.5 is used. After adding a small amount of binder to the Sialon powder, it is wet-kneaded in methanol followed by granulating by spray-drying method. Then, cold hydrostatic pressing is conducted to form four cylindrical members having an outer diameter of 210 mm, an inner diameter of 145 mm and a length of 50 mm. The sintering temperature is 1750° C., and sintering is performed in an atmosphere of nitrogen. Further, the sintered members are finished to have an outer diameter of 150 mm, an inner diameter of 118 mm and a length of 40 mm. The facial roughness of an outer-diameter sliding surface is 0.8 μm $R_{max}$.

The roll shaft 33 and a body 40 are made of stainless steel which is relatively corrosion resistant and is finished to have an outer diameter of 122.18 mm. As an intermediate buffer material 34, a pipe of JIS SUS316 stainless steel which has been subjected to tempering treatment and copper wire are alternately wound. FIG. 3 shows a condition in which they are wound on the roll shaft 33 corresponding to the cylindrical ceramic sleeve 32. Next, a cylindrical sintered Sialon member is fitted on the roll shaft 33, and as shown in FIG. 3, the ceramic sleeve 32 is retained so as to be fixed in the axial direction by a retainer member 35, a cap 36, springs 37 made of Inconel alloy and bolt screws 38 with a force of about 600 kgf, so that molten zinc is prevented from entering between the ceramic sleeve 32 and the roll shaft 33. The roll shaft 33 is designed to have a large curvature with respect to the roll body 40 so as to prevent stress concentration, and consequently, the cylindrical ceramic sleeve 32 can not be closely fitted on the roll body 40. Therefore, a space 41 is formed at a bent portion of the shaft 33, and a ring 39 is provided so that the ceramic sleeve 32 and the roll body 40 will be closely fitted. Outer peripheral angular portions of the cylindrical ceramic sleeve 32 are rounded to prevent chipping. Inner peripheral angular portions can be likewise rounded.

The roll body 40 is made of the same material as the shaft 33 and has a cylindrical shape. It is connected to a flange of the shaft by welding. With this arrangement, it is possible to decrease the roll weight sustained by the steel strip 12 to be rolled, thereby enabling rotation with less oscillation and high-speed movement of the steel strip. Recesses may be formed in the surface of the roll body so as to increase friction with the steel strip.

The pipe made of JIS SUSI316 stainless steel having an outer diameter of 2.0 mm and an inner diameter of 1.0 mm is wound, at pitches of 4 mm, on the above-described roll shaft 33 having the outer diameter of 120.0 mm, and spot welding is performed to fix both ends of the pipe on the roll shaft 33. Also, the copper wire having the same diameter as the pipe is wound between adjacent segments of the pipe. The outer diameter of the roll shaft on which the pipe is wound is 124.0 mm, and a Sialon sleeve having an inner diameter of 124.54 mm and an outer diameter of 165 mm is fitted on the roll shaft. In this case, the pipe made of JIS SUSI316 stainless steel in the molten zinc bath at 460° C. has an elasto-plastic deformation amount of 100 μm, and the pressure generated then is 1.6 kgf/mm$^2$. Since it is ⅓ of the allowable pressure (Pmax) of the Sialon sleeve which is 5 kgf/mm$^2$, there are not induced problems such as cracking. Also, the pipe made of JIS SUSI316 stainless steel has high elasticity at the temperature when it is used. Thus, it is found that stable fitting can be obtained. The copper wire is employed to enhance the thermal conductivity.

The cylindrical roll in this embodiment is formed of cast steel consisting essentially of, by weight, 0.17% C, 0.63% Si, 1.55% Mn, 13.45% Ni, 23.63% Cr and the balance of Fe, which contains eutectic carbide and is of an entire austenitic structure. Any of the shaft 33, the pressing member 35, the cap 36, the bolts 38 and the ring 39 is formed of forging quality steel of this material. The cylindrical roll is a cylinder or the like manufactured by boring, centrifugal casting process or electro-slag melting process.

Figure 4:
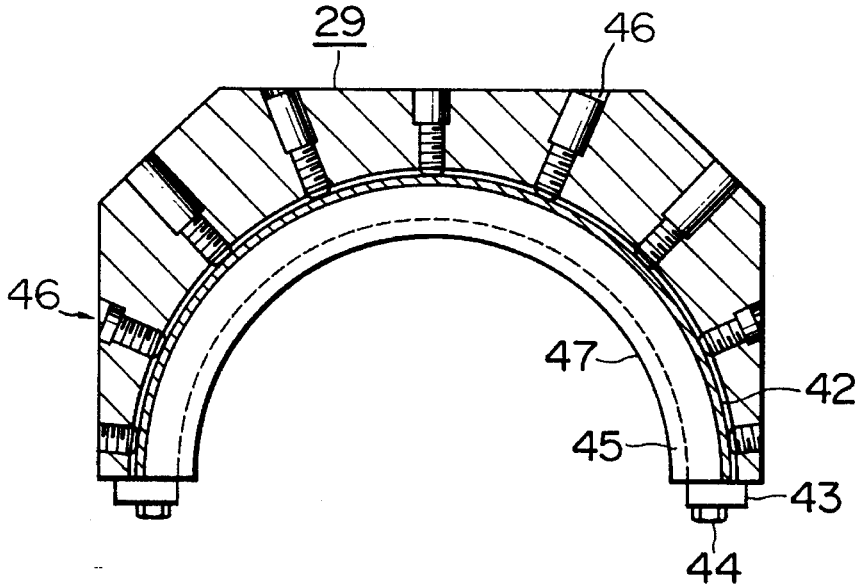
FIG. 4 is a cross-sectional view of a sink roll bearing.

FIG. 4 is a cross-sectional view of a stainless steel bearing 29 made of forging quality steel having the same composition as the roll, and four pieces of carbon fibers containing composite graphite material members (or a carbon fiber reinforced graphite members) 47 each of which is of bar like member having a semicircular shape, in general (see the generally identical member 82 in FIG. 8) and is attached on the inner peripheral surface of the bearing 29, the composite material member 47 being excellent in solid lubrication capability and corrosion resistance against molten zinc. The carbon fibers containing composite graphite material member 47 is obtained by baking it in the form of blocks. Its three-point bending strength is about 45 kgf/cm$^2$. The composite material member 47 is cut, ground and finished so that a cross section perpendicular to the peripheral direction is trapezoidal, and that the length of a side of the inner peripheral surface is smaller than that of a side of the outer peripheral surface. Carbon fibers are long fibers having a diameter of 1 to 5 μm, and 50 volume % carbon fibers are orientated in one direction and dispersed in graphite so as to be formed as a block sintered material member. The sintered material member is ground so that the longitudinal direction has various inclinations, from parallel to perpendicular, with respect to a direction of the load. The stainless steel bearing 29 is made of forging quality steel having the same composition as the above-described roll, and formed with a dovetail groove 45 having the same cross section as the above-described carbon fibers containing (C/C) composite graphite material member (or carbon fiber reinforced graphite member) 47 so that the composite material member 47 can be attached on its inner peripheral surface, and screw holes 46. More specifically, as shown in FIG. 4, the C/C composite material member 47 is placed in the dovetail groove 45 and pressed, from the rear surface, by the screws made of stainless steel having the same composition as described above through a semicircular support plate 42 made of stainless steel having the same composition as described above. End surfaces of the semicircular material are fixed by bolts 44 through pressing plates 43 made of substantially the same material. Four pieces of this semicircular C/C composite material member 47 are similarly formed in a series in the axial direction.

Figure 5:
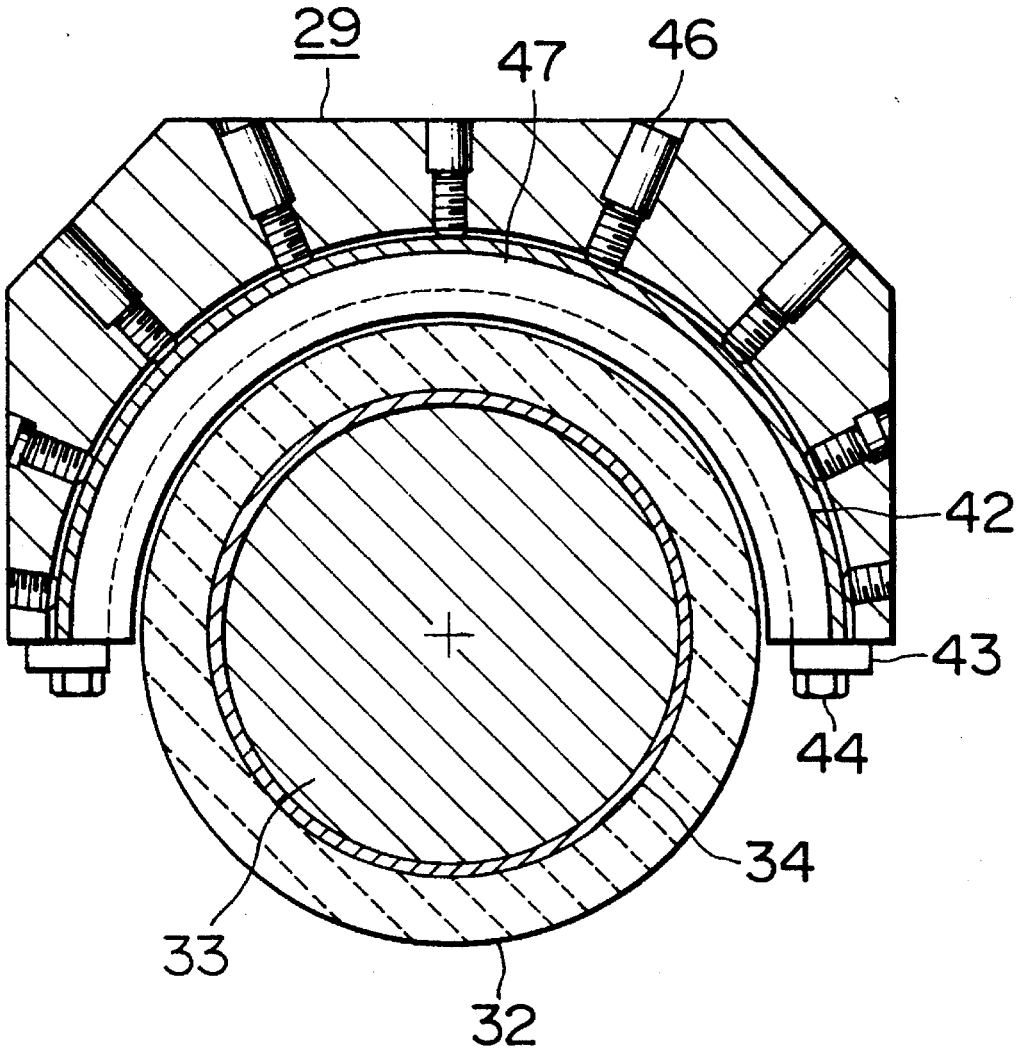
FIG. 5 is a cross-sectional view of a roll shaft and a bearing which are engaged with each other.
Figure 6:
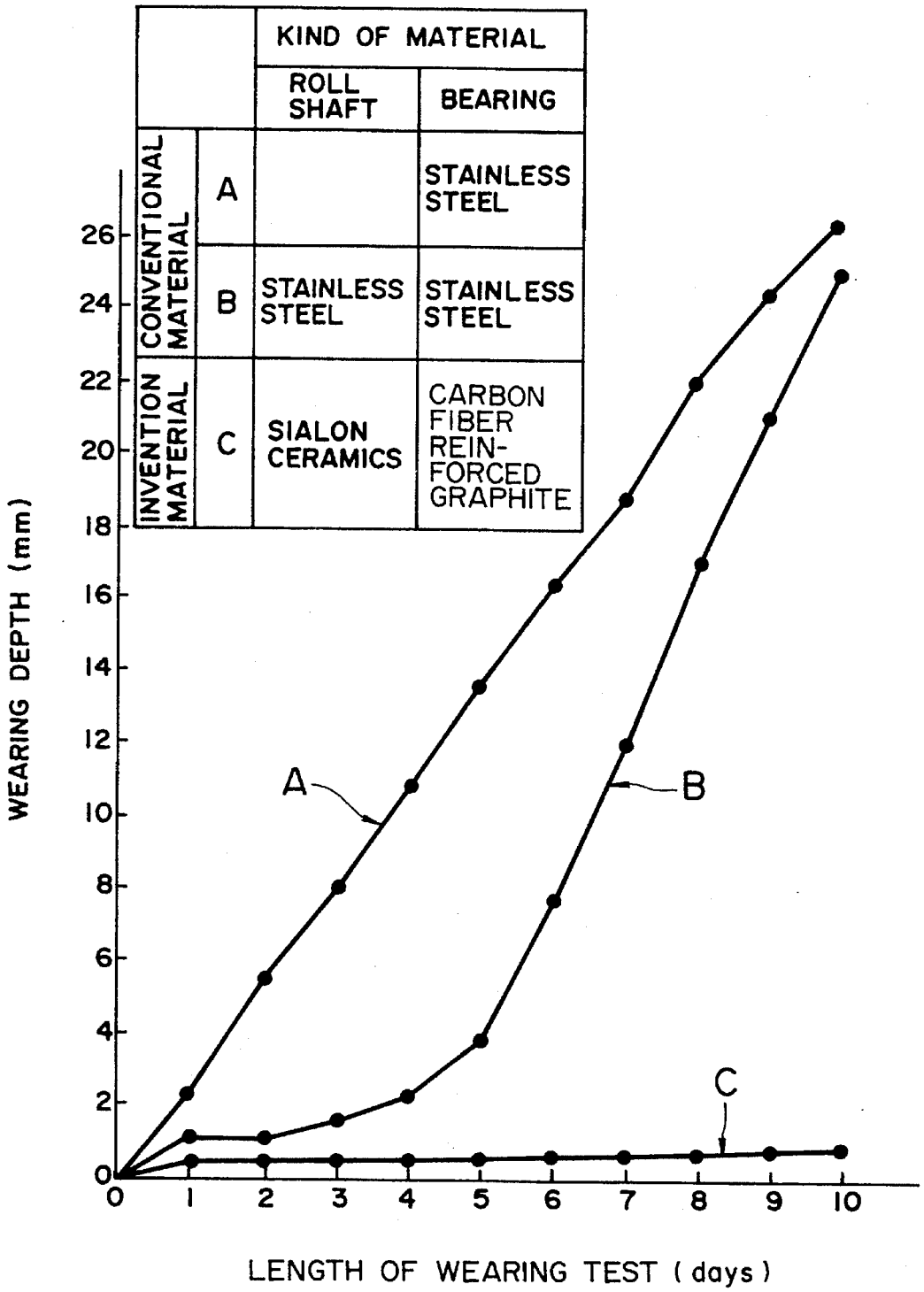
FIG. 6 is a graph illustrative of relationships between the wearing depth and the length of wearing test (days)

FIG. 5 shows a cross-sectional structure of the roll and the roll bearing having the above-described structures which are in engagement with each other. A wearing test was actually performed in the molten zinc bath. The temperature of the molten zinc bath was 450° to 480° C., and the pressing force of the roll bearing was 1300 kgf. As a result, as shown in FIG. 6, wear of the roll bearing after continuous rotation sliding for 10 days was not more than 1 mm and so small that it was 1/20 or less of wear of the conventional roll bearing. As for the conventional roll bearings, rotation sliding experiments of cylindrical bearings having different structures from this embodiment, with a roll shaft were performed for comparison, in which the roll shaft had a diameter of 150 mm and a length of 160 mm. Consequently, wear of the invention roll bearing after about 30 days was not much changed, and it was confirmed that the invention roll bearing had an excellent durability. Especially, when the carbon fibers were orientated in one direction and the sliding surface was machined to be circular, the material in which the carbon fibers were orientated most vertically in the vicinity of the center was favorable.

Concerning alloys shown in Table 1 as various kinds of steel materials for sink rolls and support rolls, corrosion depths after they were immersed in the molten Zn bath at 450° to 480° C. for 50 hours were measured. The results are shown in Table 1. As obvious from the table, a 12% Cr stainless steel and steels containing about 1% Cr were preferable. Particularly, an alloy No. 8 containing 23% Cr and 14% Ni was the most excellent.

TABLE 1

| No. | C | Si | Mn | Cr | Ni | Mo | Others | Corrosion Depth (μm) |
|---|---|---|---|---|---|---|---|---|
| 1 | 0.04 | 0.33 | 0.65 | 13.51 | 5.02 | 0.37 | — | 9.0 |
| 2 | 0.10 | 0.41 | 0.62 | 12.03 | 0.97 | 0.25 | — | 9.6 |
| 3 | 0.23 | 0.25 | 0.96 | 0.21 | 0.21 | 0.06 | — | 71.9 |
| 4 | 0.16 | 0.55 | 0.45 | 1.45 | 0.35 | 0.60 | V 0.03 Al 0.015 | 9.7 |
| 5 | 0.25 | 0.25 | 1.12 | 0.20 | 0.20 | 0.02 | — | 50.6 |
| 6 | 0.30 | 0.30 | 0.95 | 1.23 | 1.40 | 0.35 | — | 5.5 |
| 7 | 0.06 | 0.92 | 1.68 | 17.02 | 12.35 | 2.25 | — | 25.8 |
| 8 | 0.17 | 0.95 | 1.73 | 23.12 | 14.36 | — | — | 4.2 |
| 9 | 0.30 | 0.30 | 0.73 | 1.12 | — | 0.25 | — | 9.4 |

EMBODIMENT 2

With a bearing for a small-size roll having a roll shaft diameter of 50 mm and a sliding portion length of 70 mm, a wearing test similar to Embodiment 1 was performed. A C/C composite graphite material attached on the outer periphery of a roll shaft and the inner periphery of the bearing was the same material as Embodiment 1. Also, the bearing has the same structure as Embodiment 1. However, since the roll bearing has a small size, the divided bearing shown in FIG. 3 was united as an integral cylindrical member. Copper wire and a pipe of JIS SUS316 stainless steel were used as an intermediate material and fitted in substantially the same manner as Embodiment 1.

Results of the wearing test were substantially the same as the results of Embodiment 1. As for the fitting, cracking of ceramics or such trouble was not induced, and favorable results were obtained.

EMBODIMENT 3

A roll shaft 33 of JIS SUSI316 stainless steel having an outer diameter of 111.5 mm which had substantially the same structure as that of Embodiment 1 was used. An intermediate member comprising a cylindrical member made of JIS SUSI316 stainless steel which had a thickness of 2 mm and an inner diameter slightly larger than 111.5 mm, and angular projections having a tip angle of 60° and a height of 1 mm which were formed on the outer surface of the cylindrical sleeve at pitches of 6 mm in the peripheral direction, was provided around the roll shaft, and a Sialon sleeve having an outer diameter of 150 mm and an inner diameter of 116 mm was fitted in substantially the same manner as Embodiment 1. In this case, a shrinkage fitting degree at 460° C. was about 50 μm, a generated stress was 1 kg/mm$^2$. Therefore, the allowable stress of ceramics was ⅓ of 3 kgf/mm$^2$ of Pmax, and it was a favorable value.

Concerning this roll shaft, a rotation wearing test was performed in substantially the same manner as Embodiment 1. The wearing depth was the same as Embodiment 1. In this embodiment, the buffer material had a slight corrosion resistance against molten zinc, and consequently, Embodiment 3 was more excellent in respect of damage of the shaft than Embodiment 1. The fitting strength at high temperature was high.

Further, a tape made of pure copper was wound as an intermediate material 34. Taking a thermal expansion difference at 450° C. of molten zinc plating temperature into consideration, a space corresponding to 2% of the volume was formed, and a ceramic 32 was fitted. Cracking of the ceramic 32 due to such fitting was not caused.

EMBODIMENT 4

In substantially the same manner as Embodiment 1, a sintered Sialon sleeve was used for a sink roll, and sintered SiC-graphite members were used for a bearing. This embodiment was different from Embodiment 1 in that a pipe of JIS SUS316 stainless steel and pure copper wire were alternately wound over the entire area of the roll shaft where the sintered ceramic member existed, to such a degree that the pipe and the wire were contacted with each other, and that the ceramic sleeve was fitted after that. In this case, a gap between the ceramic and the outer diameter of the roll shaft was partially in linear contact with the copper wire. However, plastic deformation and elastic deformation of the copper wire were induced in the hot dipping molten zinc at 450° C. and planar contact was obtained. It was thus confirmed that strong fitting of the ceramics was obtained without cracking.

The bearing was different from that of Embodiment 1 only in respect of the material. It was quite the same in other respects.

The above-mentioned sintered composite SiC-graphite ceramic member was formed by adding 25 weight parts of graphite powder having an average grain size of 10 μm to 100 weight parts of SiC powder having an average grain size of 3 μm, wet-kneading the mixture with a small amount of binder in methanol, drying it, and granulating it by a milling and mixing operation. Subsequently, it was pressed by a mechanical press and molded into a disk shape having a thickness of 30 mm and an outer diameter of 100 mm or more, and sintered in vacuum at 2100° C. by hot press method. Further, the sintered member was ground, cut and finished into four divided semicircular blocks having a trapezoidal cross section.

EMBODIMENT 5

A roll made of the stainless steel obtained in Embodiment 1 was used as a sink roll 19, and support rolls 20 made of integral forged quality steel which had substantially the same structure and a diameter smaller than the sink roll were used. They were attached in the molten zinc hot dipping apparatus illustrated in Embodiment 1. While a steel strip having a thickness of 0.8 mm was being moved at 90 m/minute, layers of Zn plating having an amount of 100 g/m$^2$ were formed on both surfaces of the steel strip, and the operation was continuously carried out for 10 days. The guide rolls 20 were designed to be forcibly rotated when rotational torque was exerted on them from the outside.

Figure 7:
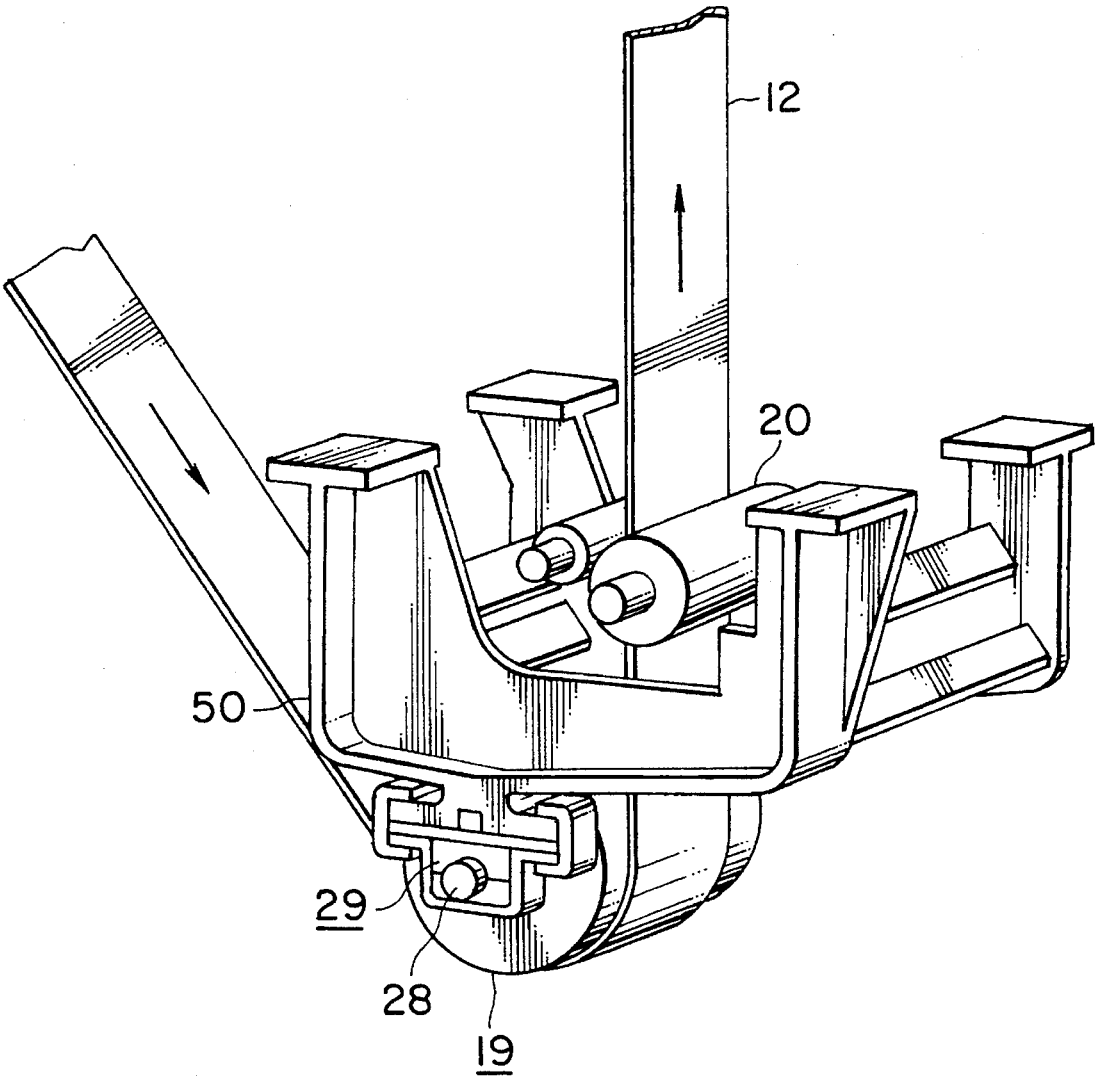
FIG. 7 is a perspective view of a sink roll and a bearing in a hot dipping metal which are mounted on a frame.

FIG. 7 illustrates locations of the sink roll 19 in the hot dipping apparatus, a frame 50 for supporting a bearing 29, and the support rolls 20 for guiding the steel strip 12. Although not shown, a cylindrical ceramic sleeve is closely fitted on a roll shaft of each of the support rolls 20 through an intermediate material in substantially the same manner as Embodiment 1.

In this embodiment, the sink roll 19 in the hot dipping tank, the support rolls 20, the frame 50, and bearings for them are all made of the stainless steel used in Embodiment 1. The frame 50 is a casting containing eutectic carbide and having an entire austenitic structure.

Figure 8:
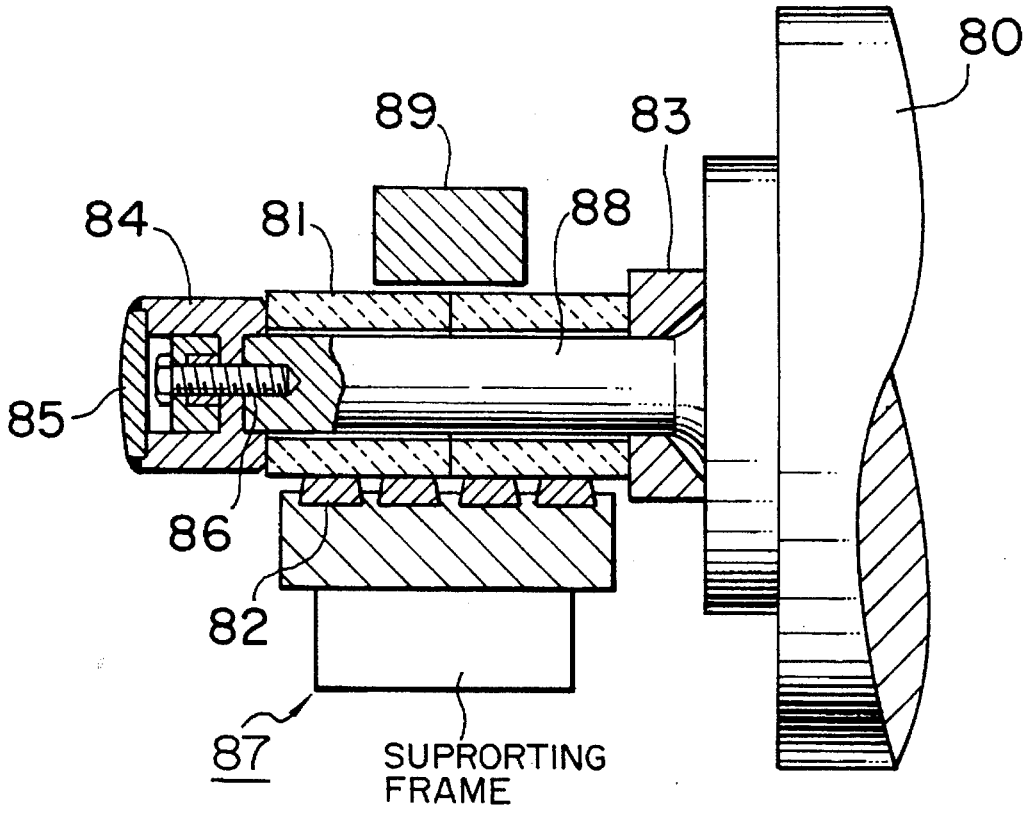
FIG. 8 is a cross-sectional view of a support roll and a bearing which are engaged with each other.

FIG. 8 is a partial, cross-sectional view showing a support roll 80 and its bearing 87 which are in engagement with each other. As shown in FIG. 2, roll surfaces of support rolls are pressed against a steel strip 12 from both sides, and contacted with the steel strip in such a manner that their contact surfaces are displaced from each other. Each bearing 87 is provided with four pieces of a carbon fiber reinforced graphite 82 of composite material having a semicircular shape, as indicated by portions shadowed by oblique lines in the figure, which have substantially the same structure as shown in FIG. 4. Since no force is particularly exerted on the opposite half portion 89 of the bearing 87, it is formed of the above-mentioned metal. Also, two sleeves 81 made of sintered Sialon material, as described above, are closely fitted on a support roll shaft 88 through a pipe of JIS SUS316 stainless steel and copper wire in substantially the same manner as shown in FIG. 3. A metal ring 83 is interposed between a root portion of the shaft and a body, and a pressing member 84 is used to fix the shaft by a screw 86 through a spring, with a cap 85 being securely attached by welding. The support rolls have bodies whose diameters are different from each other, and are located below the surface of molten metal, so as to suppress oscillation of the steel strip. Usually, the method of exerting rotational torque on these two support rolls from the outside is employed, and it can be likewise employed in this embodiment. However, since the shaft sliding efficiency is remarkably high, it is unnecessary to apply the driving force from the outside. The operation can be performed with substantially constant tension in the traveling direction of the steel strip during this operation, and with substantially constant injection of gas from the wiping nozzles 21, and also, there is extremely little oscillation of the steel strip after molten Zn is coated on the steel strip. Since the steel strip after molten Zn hot dipping is moved vertically upwards for about 5 m and cooled, even slight oscillation of the roll shafts is transmitted to the steel strip. In this embodiment, however, oscillation of the steel strip is caused only slightly during the operation.

In this embodiment, the Zn plating amount was set at 40 $g/m^2$ or 30 $g/m^2$, and steel strips were continuously produced for one week, 10 days and 20 days, to thereby manufacture a new product in each period. In this embodiment, there was induced little wear of the roll shafts in substantially the same manner as Embodiment 1, and the steel strip oscillated only slightly, so that it was possible to obtain a steel strip which was plated with zinc layers having a substantially uniform thickness. Fluctuation of the tension of the steel strip at this time and deviation of the gas injection condition were extremely small. They were not more than about 10%. Fluctuation of the plating amount per unit area was as small as 3 to 4%.

EMBODIMENT 6

The above-described C/C composite graphite sleeve having the same size was used in place of the Sialon sleeve, and it was closely fitted on a roll shaft made of JIS SUSI316 stainless steel of Embodiment 3 according to the method illustrated in Embodiment 1. A semicircular sintered Sialon member was used as a bearing, and closely fitted in substantially the same manner as Embodiment 1. Then, molten zinc plating for a thickness of about 20 μm was effected continuously for 10 days in substantially the same manner as described before. As a result, it was found that wear of the roll shaft and the bearing was extremely small, and that deviation of the zinc plating thickness during this operation was extremely small.

EMBODIMENT 7

A sink roll comprising the roll and the roll bearing which are obtained in Embodiment 1 was used, and continuous plating operation was performed by dipping a steel strip in molten aluminum at 680° C. at high speed. As a result, although the wearing depth of a roll bearing made of the conventional steel was about 15 mm after four days, wearing depths of the roll and the bearing according to this invention were about 0.25 mm, and wear was as small as 1/60 of the conventional products. Moreover, when the roll bearing of the invention was used for 12 days without replacement, the wearing depth was not more than 1 mm, and its effect was confirmed.

In order to confirm another effect of the present invention, the roll bearing was removed after it was used for 12 days, and those regions of four pieces of the C/C composite material which were used for operation were moved. After the trial, abnormal wear was not particularly observed, and the wearing depth after use of 12 days was not more than 1 mm and as small as the first time of use. It was found that expensive ceramics can be utilized effectively because the identical C/C composite graphite material can be repeatedly used with substantially the same wear condition if it is used in this manner, and because it can continue to be used if the sliding surfaces of the ceramics are ground after a certain period of time.

Conventionally, two identical apparatus containing molten zinc or aluminum have been alternately used substantially once a week because sink rolls wear conspicuously. In this embodiment, however, the operation can be performed by an individual apparatus. Moreover, wear of the roll is extremely small, so that the replacement term can be made longer than the conventional case, and the replacement can be conducted every 20 days or more or every month.

The looper 23 mentioned before can be eliminated.

EMBODIMENT 8

Figure 9:
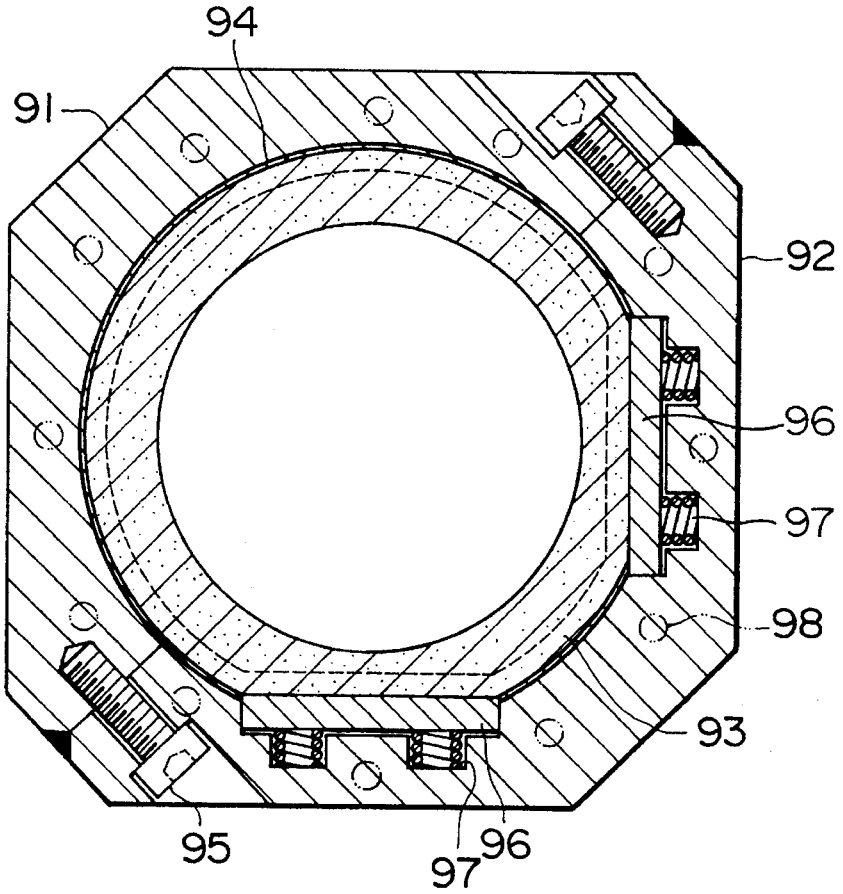
FIG. 9 is a plan view of another embodiment of a sink roll bearing.
Figure 10:
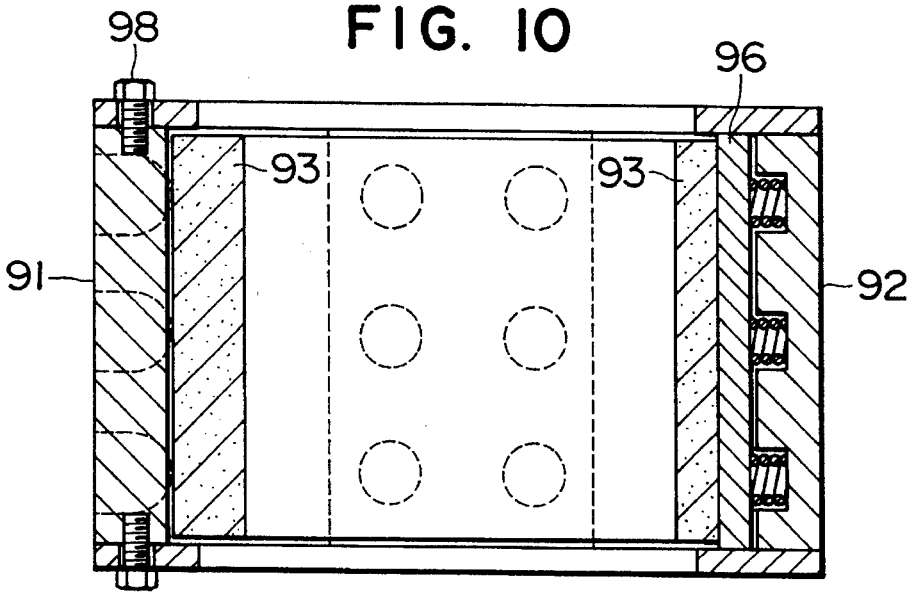
FIG. 10 is a partial, cross-sectional side view of the sink roll bearing of FIG. 9.

This embodiment has substantially the same structure as Embodiment 1 except that a bearing shown in FIGS. 9 and 10 is used in place of the sink roll bearing of Embodiment 1 shown in FIG. 4. FIG. 9 is a plan view of the sink roll bearing. A cylindrical composite graphite material sleeve (or carbon fiber reinforced graphite sleeve) 93 in which carbon fibers are dispersed in one direction is securely fixed on metallic bases 91 and 92 through a graphite felt 94 by means of bolts 95. The composite graphite material sleeve 93 is designed to be a sliding surface with respect to a sink roll shaft. The composite graphite material sleeve 93 is fixed by springs 97 through pressing plates 96. The sleeve 93 is arranged so that the carbon fibers intersect with the contact surface of the roll shaft. FIG. 10 is a partial, cross-sectional view of FIG. 9, as viewed from a side.

When the entire periphery of the contact surface of the bearing is formed of the integral composite graphite material sleeve 93 in this manner, further long-term durability can be obviously obtained, as compared with Embodiment 1. In continuous molten zinc plating for four days, fluctuation of the plating amount was not more than 5 $g/m^2$ and remarkably small. It was understood that products of excellent quality can be obtained.

As will be apparent from the above, according to the present invention, the ceramic material which is excellent in respect of corrosion resistance, wear resistance and sliding properties is provided on the slide contact portion of the roll shaft, and the solid lubricant member is provided on the bearing so as to make the entire periphery circular or semicircular. Therefore, wear of the roll bearing in the hot dipping molten metal is small, and the roll bearing has long-term durability. It is possible to conduct the operation ten times longer than the case with a roll bearing made of the conventional metal. Thus, this invention produces effects such as decreasing replacement frequency of the roll bearing, improving the productivity by continuous operation, reducing defective products, and so forth.

The present invention can also be applied to slide bearing structures and sliding members for use in chemical plants, furnaces, heaters, space equipments and the like which are high-temperature apparatus which has be kept away from oil, and long-term durabilities can be obtained.

What is claimed is:

1. A continuous hot dipping apparatus including at least one roll which is supported by a bearing and rotates in a molten metal, wherein said roll is made of a heat resistant alloy, a cylindrical sintered ceramic sleeve is fitted and secured on the entire periphery of a roll shaft of said roll, said roll shaft and a roll body is an integral structure, an intermediate portion between said roll shaft and said roll body becomes gradually larger in diameter from said roll shaft to said roll body, and a metallic ring is mounted on the intermediate portion between said cylindrical sintered ceramic member and said roll body.

2. A continuous hot dipping apparatus comprising at least one roll which is supported by a bearing and rotates in a molten metal, wherein a composite graphite member containing carbon fibers having a bending strength of 10 $kg/mm^2$ or more is fitted and secured on an inner surface of a metallic base of said bearing or a slide-contact portion of a roll shaft of said roll, said carbon fibers being dispersed and oriented in a single direction in said composite graphite member with a longitudinal direction of said carbon fibers being oriented to intersect with the slide contact surface of said composite graphite member.

3. A sink roll of a continuous hot dipping apparatus, which is made of a heat resistant steel consisting essentially of, by weight, 0.15 to 0.30% C, not more than 2% Si, not more than 2% Mn, 20% to 30% Cr, 10 to 20% Ni, and not less than 60% Fe, and comprises a cylindrical sintered ceramic sleeve divided into a plurality of sections in the axial direction which is fitted and secured on the entire periphery of slide-contact surfaces of said roll with respect to a bearing.

4. A guide roll of continuous hot dipping apparatus made of a heat resistant steel consisting essentially of, by weight 0.15 to 0.30% C, not more than 2% Si, not more than 2% Mn, 20 to 30% Cr, 10 to 20% Ni, and not less than 60% Fe, and comprising a cylindrical sintered ceramic sleeve which is fitted and secured on the entire perphery of a slide contact surface of said roll with respect to a bearing.

* * * * *